US010735876B2

(12) United States Patent
Ngai et al.

(10) Patent No.: US 10,735,876 B2
(45) Date of Patent: Aug. 4, 2020

(54) METHOD FOR DETERMINING USEFUL HEARING DEVICE FEATURES

(71) Applicant: SONOVA AG, Stäfa (CH)

(72) Inventors: Raymond Ngai, Scarborough (CA); Betty Rule, Hamilton (CA); Galen Dunning, Kitchener (CA)

(73) Assignee: Sonova AG, Stäfa (CH)

( * ) Notice: Subject to any disclaimer, the term of this patent is extended or adjusted under 35 U.S.C. 154(b) by 272 days.

(21) Appl. No.: 15/552,505

(22) PCT Filed: Mar. 13, 2015

(86) PCT No.: PCT/EP2015/055351
§ 371 (c)(1),
(2) Date: Aug. 22, 2017

(87) PCT Pub. No.: WO2015/075279
PCT Pub. Date: May 28, 2015

(65) Prior Publication Data
US 2018/0035221 A1 Feb. 1, 2018

(51) Int. Cl.
*H04R 25/00* (2006.01)

(52) U.S. Cl.
CPC ..... *H04R 25/70* (2013.01); *H04R 25/30* (2013.01); *H04R 2225/39* (2013.01); *H04R 2225/41* (2013.01)

(58) Field of Classification Search
USPC ..... 381/314, 315, 318, 316, 320
See application file for complete search history.

(56) References Cited

U.S. PATENT DOCUMENTS

2007/0237346 A1* 10/2007 Fichtl ..... H04R 25/70 381/314
2008/0226105 A1* 9/2008 Barthel ..... H04R 25/70 381/313
2009/0298431 A1* 12/2009 Rasmussen ..... H04R 25/554 455/41.3
2010/0220879 A1* 9/2010 Feilner ..... H04R 25/70 381/314
2015/0010159 A1* 1/2015 Tran ..... H04R 25/70 381/60

* cited by examiner

*Primary Examiner* — Fan S Tsang
*Assistant Examiner* — Julie X Dang

(57) ABSTRACT

The present invention proposes a method for determining hearing device features which are useful to an individual user of a hearing device (1). According to the proposed method a received input sound signal is automatically classified according to N sound classes. An overall usage quantity is then determined for each sound class from logged usage quantities of each sound class. Useful hearing device features are then determined, which are suitable for processing an input sound signal associated with sound classes having an overall usage quantity that exceeds a minimum overall usage quantity. Subsequently, providing the determined useful hearing device features in the hearing device (1) is suggested to the fitter and/or user of the hearing device (1). In a further aspect of the present invention a hearing device (1) with a classifier (7) and a logging unit (10) adapted to log usage quantities for identified sound classes is provided.

10 Claims, 2 Drawing Sheets a) b)

METHOD FOR DETERMINING USEFUL HEARING DEVICE FEATURES

CROSS-REFERENCE TO RELATED APPLICATIONS

This utility patent application claims the priority date and benefit of International Application Number PCT/EP2015/055351 filed on Mar. 13, 2015.

TECHNICAL FIELD

The present invention pertains to a method for determining hearing device features which are useful to an individual user of the hearing device.

BACKGROUND OF THE INVENTION

Hearing devices such as hearing aids (also referred to as hearing prostheses or hearing instruments) for hard of hearing people or hearing enhancement devices for augmenting the hearing capability of normal hearing persons, as well as hearing protection devices designed to prevent noise-induced hearing loss, commonly comprise an input transducer, e.g. a microphone, for picking up sound from the surroundings, a signal processing unit for processing the signal from the input transducer, and an output transducer, e.g. a miniature loudspeaker also called a receiver, for converting the processed signal into a signal perceivable by the user of the hearing device. Typically, such hearing devices are adapted to be worn at the ear (e.g. a behind-the-ear, BTE hearing device) or within the ear canal (e.g. an in-the-ear, ITE or completely-in-canal, CIC hearing device), or alternatively to be partly anchored in the scull (e.g. a bone-anchored hearing aid, BAHA) or partly implanted in the middle or inner ear (e.g. a direct acoustic cochlear stimulation, DACS, or cochlear implant). Furthermore, such hearing devices commonly incorporate a number of different functionalities or features, each one potentially providing a specific benefit to the user in order to improve the user's hearing experience to various degrees. Usually, some basic features are provided in all hearing devices, whereas advanced features, for instance employing more sophisticated audio signal processing such as adaptive beamforming and binaural signal processing, or providing more complex functionalities such as wireless audio streaming, are only offered by high-end hearing devices, which are therefore more expensive.

A hearing device professional, such as an audiologist or hearing aid acoustician, often referred to a hearing device "fitter", is challenged with selecting a suitable hearing device model along with appropriate features depending on the needs and preferences of an individual user. It is difficult to determine which features will be useful to a certain user, i.e. will provide an individual benefit to this user in terms of improving the user's hearing capability or hearing experience. Because the user has to pay for additional hearing device features, such as extra hearing programs, or may even have to buy a more advanced and therefore more expensive hearing device, users will often decide to do without features which they think will provide little or no benefit to them. It is therefore usually difficult for both a hearing device professional as well as for a hearing device user to make a sound decision regarding which hearing device features are useful for the user. Hence, there is a need for means that allow a hearing device professional and/or a hearing device user to determine whether a certain hearing device feature will likely be useful to the user, i.e. will provide an individual benefit to this user in terms of improving the user's hearing capability or hearing experience.

SUMMARY OF THE INVENTION

It is an object of the present invention to provide a method for determining hearing device features which will likely be useful to an individual user of the hearing device, more specifically a method for suggesting such hearing device features to a hearing device professional and/or to the user of a hearing device.

This object is achieved by the method according to claim 1. Specific embodiments of the proposed method are provided in the dependent claims 2 to 12. A hearing device capable of supporting the proposed method is specified in claims 13 and 14.

The present invention provides a method for determining hearing device features which are useful to an individual user of the hearing device, the method comprising:

a) receiving an input sound signal;

b) automatically classifying the input sound signal according to N≥2 sound classes and/or signal types, thereby associating the input sound signal with one of the sound classes or signal types;

c) logging a usage quantity for said one of the sound classes or signal types;

d) determining for each sound class or signal type an overall usage quantity from the logged usage quantities of each sound class or signal type;

e) determining sound classes or signal types having an overall usage quantity exceeding a minimum overall usage quantity as being relevant sound classes or signal types for the user;

f) determining for each relevant sound class or signal type useful hearing device features, such as a hearing program, suitable for processing an input sound signal associating with the relevant sound class or signal type; and g) providing information with respect to, in particular suggesting, providing the useful hearing device features in the hearing device of the user.

Sound classification can for instance be performed by the methods such as provided in EP 1 348 315 B1, WO 02/32208 A2, U.S. Pat. No. 7,653,205 B2 and WO 2011/027004 A2. Specific sound classes may for instance be speech, noise, speech in noise, speech in quiet, speech in a crowd, reverberated speech, music and wind noise. Specific signal types may for example be a sound signal pickup by one or more microphones, an audio signal from a t-coil or an audio signal wirelessly transmitted from a remote location, e.g. from a remote microphone, a telephone signal or a streamed audio signal from a multimedia player, radio or television.

In this way the specific hearing situations a certain individual user is commonly confronted with can objectively be determined based on the sound classes and/or signal types identified by a classifier. Based upon the individual overall usage quantities logged by the hearing device during actual use of the hearing device by the user those hearing situations that the user is in most frequently can be established and from this the hearing device features which are known to be effective in these hearing situations can be identified. This information is then provided to the hearing device professional and/or the user of the hearing device, so that a well-founded decision can be made as to which hearing device features will be useful to the user and therefore provide a hearing benefit, thus being worth the extra cost.

In an embodiment the method further comprises the user or a hearing device fitter, such as an audiologist, selecting at least one of the useful hearing device features for being provided in the hearing device of the user.

In a further embodiment the method further comprises providing at least one of the useful hearing device features in the hearing device of the user.

In a further embodiment the method further comprises removing or disabling at least one hearing device feature, which is not a useful hearing device feature, from or in the hearing device of the user. By employing the proposed method for determining hearing device features which are useful to the user of the hearing device it is also possible to establish that a hearing device feature presently available in the hearing device is superfluous, i.e. provides little or no benefit to the user in terms of improving his hearing performance. Therefore, the user may decide to drop this feature, e.g. in order to save cost, or to replace it with a better, e.g. more useful feature.

In a further embodiment of the method, as part of providing information in step g) a degree of usefulness is provided for each useful hearing device feature based on the logged usage quantities.

In a further embodiment of the method the information, in particular the suggestion, mentioned in step g) is provided within a fitting system, in particular presented, such as visualised, as part of a fitting process. In this way, e.g. by providing a graphical bar or pie diagram depicting the usefulness of each feature, the fitter and/or user can very quickly identify hearing device features which are useful to achieve good hearing performance for this user as well as those that are less or not at all useful for this user.

In a further embodiment the method further comprises:

prior to step a)

providing P1 hearing programs in the hearing device, wherein P1≥2; and associating each one of the P1 hearing programs with one of the N sound classes and/or signal types, wherein N>P1, and subsequent to step b)

determining whether one of the hearing programs is associated with the one of the sound classes and/or signal types associated with the input sound signal; and activating said one of the hearing programs.

In known hearing devices a certain number P1 of hearing programs (e.g. combinations of features for instance with certain predefined settings) are available and can be selected either automatically by hearing device itself or manually by the user. Automatic selection is typically based on the hearing situation identified by a classifier in terms of the sound class representative for the current hearing situation. Therefore, there is usually a one-to-one mapping of sound classes to hearing programs, i.e. a distinct hearing program is associated with each sound class. Hence, the number P=P1 of hearing programs is equal to the number N of sound classes (or signal types). Consequently, the classifier in a more advanced (version of a) hearing device with a larger number P=P1 of hearing programs (i.e. having more hearing device features) will be able to distinguish between a larger number N of sound classes. According to the present invention, an advanced classifier is even used in a lower end hearing device having only a small number P=P1<N of hearing programs (i.e. features) in order to be able to identify hearing situations that would profit from more advanced hearing programs (or additional features). Providing information for instance regarding the amount of time a certain user is faced with hearing situations for which the user's hearing device is not equipped with the necessary features to provide optimal hearing performance, helps the fitter and/or user to identify additional features which would be useful (i.e. provide a performance benefit) to the user in the future when such hearing situations occur. In this way, the user will be far more willing to buy the extra features (or alternatively a more advanced hearing device), because he is then convinced that he will clearly benefit from these extra features.

In a further embodiment the method further comprises determining a coverage score dependent on whether a hearing program was associated with the classified sound class and/or signal type or whether no hearing program was available for the classified sound class and/or signal type. In this way, the coverage score can be an immediate indication (e.g. in a single value) of the proportion of individual hearing situations which the user is exposed to are dealt with optimally with the features presently available in the hearing device, and on the other hand the proportion of individual hearing situations which the user is exposed to that could be dealt with more optimally using additional features presently not available in the hearing device.

In a further embodiment the method further comprises providing an indication of a degree of possible performance improvement achievable for the user by providing further hearing device features based on the coverage score. In this way, an immediate indication (e.g. in a single value) can be provided to the fitter and/or user in terms of how much performance improvement could be gained by providing certain additional hearing device feature based on the individual hearing situations the user is normally exposed to, as determined from the sound classes identified by the classifier.

In a further embodiment the method further comprises:

subsequent to step g)

providing at least one further hearing program in the hearing device, such that P2>P1 hearing programs are available in the hearing device; and associating each one of the P2 hearing programs with one of the N sound classes and/or signal types, wherein N≥P2.

In this way, increased hearing performance is achieved for the user by providing additional hearing programs in the hearing device of the user, which are capable of dealing with hearing situations the user is commonly in.

In a further embodiment of the method the usage quantity is one of:

A) an occurrence where the input sound signal was associated with a sound class or signal type;

B) a time duration during which the input sound signal was associated with a sound class or signal type;

C) either A) or B) weighted by a probability that the input sound signal was correctly associated with the sound class or signal type.

In a further embodiment of the method the overall usage quantity is one of:

D) a total or relative number of occurrences where the input sound signal was associated with a sound class or signal type;

E) a total or relative time duration during which the input sound signal was associated with that sound class or signal type;

F) a total or relative quantity based on either A) or B).

It is explicitly pointed out that combinations of the above-mentioned embodiments of the proposed method can yield even further, more specific embodiments of the method according to the present invention.

In a further aspect, the present invention provides a hearing device comprising:

a transducer for receiving a sound signal;

a classifier adapted to automatically classify the input sound signal according to N sound classes and/or signal types, thereby associating the input sound signal with one of the sound classes or signal types;

a logging unit adapted to log a usage quantity for said one of the sound classes or signal types;

a signal processing unit adapted to apply one of P hearing programs to the input sound signal in dependence of which sound class or signal type the input sound signal is associated with, wherein N>P, such that at least one sound class or signal type is not associated with a hearing program, and thus is merely relevant for logging a usage quantity.

Embodiments of the proposed hearing device are further adapted to support the method according to the previously mentioned embodiments of the proposed method.

These and further objects, features and advantages of the present invention will become apparent from the following description when taken in connection with the accompanying drawings which, for purposes of illustration only, show several embodiments in accordance with the present disclosure.

BRIEF DESCRIPTION OF THE DRAWINGS

The present invention is further explained in the following by means of non-limiting specific embodiments and with reference to the accompanying drawings, which show.

DETAILED DESCRIPTION OF THE INVENTION

Figure 1:
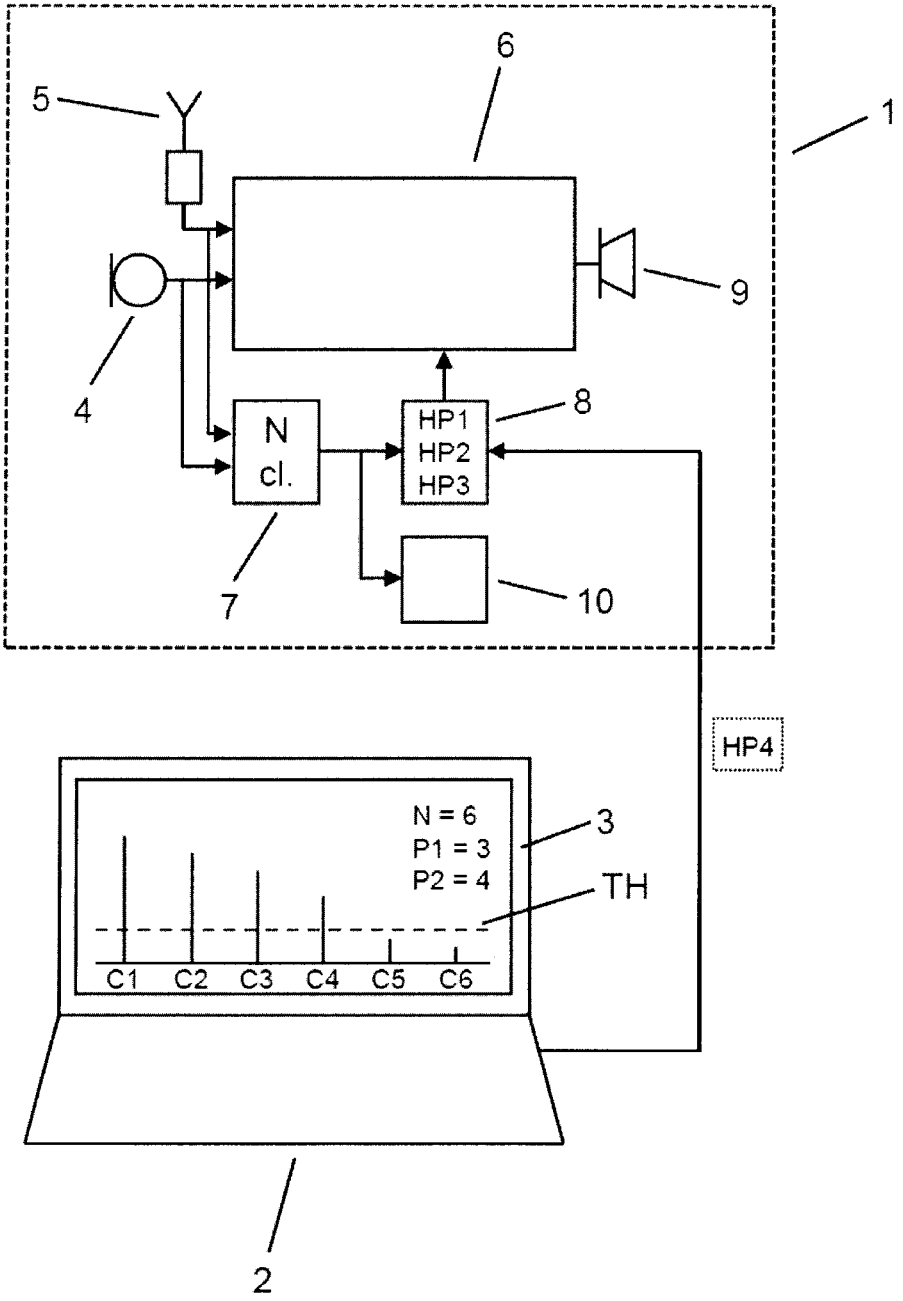
FIG. 1 a high-level block diagram of an exemplary setup for performing the method according to the present invention.

FIG. 1 depicts a high-level block diagram of an exemplary setup comprising a hearing device 1 and a fitting terminal 2 for performing the method according to the present invention. The upper half of FIG. 1 shows various units of the hearing device 1, and the lower part illustrates the fitting terminal 2 with a graphical display 3. Ambient sound is picked up by the hearing device 1, e.g. by means of a microphone 4. Alternatively, a sound signal recorded at a remote location can be sent wirelessly to the hearing device 1 where it is received via the antenna 5 (e.g. a t-coil). The input sound signal is then provided both to an audio signal processing unit 6 as well as to a classifier 7. The classifier 7 automatically classifies the input sound signal according to N sound classes and/or signal types, thereby associating the input sound signal with one of the N sound classes or signal types. Subsequently, a feature selection unit 8 selects based on the identified sound class the features, for instance one of P<N hearing programs comprising a specific set of functions along with specific parameter settings for these functions, which are then applied by the signal processing unit 6 to the received input sound signal. The processed input sound signal is then output for instance via a loudspeaker 9. Moreover, a logging unit 10 logs a usage quantity for the identified sound class or signal type. Preferably, the logging unit 10 continuously determines an overall usage quantity for each sound class or signal type from the logged usage quantities of each sound class or signal type. In this way, the storage of large data quantities can be avoided.

After using the hearing device 1 for a period of time, such that the user of the hearing device 1 has been exposed to a range of real-life hearing situations which are typical for the specific user, the sound classes or signal types having an overall usage quantity exceeding a minimum overall usage quantity are identified as relevant sound classes or signal types for the user. Then hearing device features, such as a hearing program, are identified for each of the determined relevant sound classes or signal types, which are suitable for processing an input sound signal associated with the relevant sound class or signal type. The identified hearing device features will be referred to as "useful" hearing device features, because they improve the hearing performance of the user in those situations when the received sound is determined to belong to the corresponding sound class or signal type. Information regarding the useful hearing device features can then be provided to the user and/or fitter of the hearing device. A fitting system can for instance suggest to incorporate (or enable) a certain useful hearing device feature, which is presently not provided by the hearing device 1, in the hearing device 1. An additional hearing program identified as being useful, could then be uploaded to the hearing device 1 or enabled for use in the hearing device 1 (if already store therein, but inhibited from being employed by some means until the feature has been unlocks, e.g. against payment of a fee).

An exemplary graphical presentation of the overall usage quantity for each sound class is shown on the display 3 of the fitting terminal 2 in the lower half of FIG. 1. This information is provided for instance in the form of a bar chart/graph. In this example the classifier 7 can distinguish between N=6 different sound classes (and/or signal types). As can be seen four sound classes are encountered predominantly, e.g. their relative frequency lies above a threshold TH. This means that the user is in hearing situations that correspond to these four sound classes most of the time.

Figure 2:
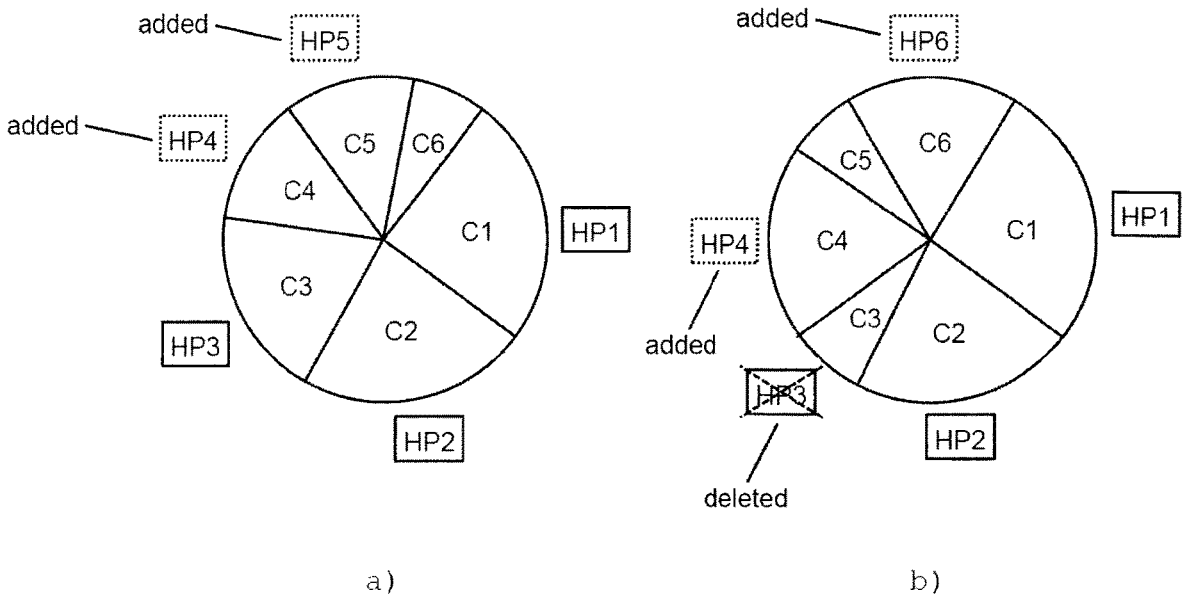
FIG. 2*a* an exemplary graphical presentation of an overall usage quantity for each sound class for a first user.
FIG. 2*b* an exemplary graphical presentation of an overall usage quantity for each sound class for a second user.

FIG. 2*a* illustrates an alternative graphical example of the overall usage quantity for each sound class that can be distinguished by the classifier 7. Here this information is provided in the form of a pie chart/graph. As can be seen the sound classes C1 to C3 are the ones most frequently encountered by a user A in his everyday life. Hearing programs HP1 to HP3 provided in the user's hearing device are associated with these three sound classes C1 to C3 and selected each time when the corresponding sound class is identified. Furthermore, user A is also quite frequently in hearing situations that correspond to the sound classes C4 and C5. However, the hearing device 1 cannot optimally process the received sound signal in these hearing situations, because no hearing program specifically tailored to handle these hearing situations in available in the hearing device 1. Therefore, the fitting system could for instance suggest to the user and/or the fitter to provide the hearing programs HP4 and HP5 in the hearing device 1 in order to improve the achievable hearing performance of user A in hearing situations where the sound classes C4 and C5 occur, which is still quite commonly the case for user A. Because user A is only infrequently (e.g. below a certain minimal relative time duration) in a hearing situation where sound class C6 is identified, the hearing device features, e.g. hearing program HP6 (such as a hearing program dedicated to listening to music), associated with the sound class C6 (e.g. music) are not considered to be useful features for user A, since the cost of the extra features is not justified by the minor benefit provided by these extra features, because there are only rarely employed.

The hearing situations encountered by another user B can be quite different to those of previous user A as illustrated in FIG. 2*b*. Like user A, user B is mainly in the two hearing situations corresponding to sound classes C1 and C2. However, he is only infrequently in hearing situations corresponding to sound class C3. Therefore, user B benefits only little from hearing program HP3 which is provided in the hearing device 1. On the other hand, user B is also quite frequently in hearing situations corresponding to sound classes C4 and C6. Therefore, the fitting system may propose to user B and/or the fitter of user B's hearing device 1 to replace hearing program HP3 with hearing program HP4, which user B will benefit from much more frequently. Furthermore, the fitting system may suggest to provide the hearing programs HP4 and HP6 (e.g. optimised for listening to music) in the hearing device 1 of user B (e.g. who often listens to music) in order to improve the achievable hearing performance of user B in hearing situations where the sound classes C4 and C6 (e.g. in a concert hall) occur. User B would then for instance only have to pay for the additional hearing program HP6, because hearing program HP3 is replaced by the more useful (since more frequently used) hearing program HP4.

What is claimed is:

1. A method for operating a hearing device, the method comprising:

using a hearing device to receive an input sound signal;

classifying, by the hearing device, the input sound signal according to N sound classes and/or signal types by associating the input sound signal with one of the N sound classes or signal types;

logging, by the hearing device,-a usage quantity on the hearing device for said one of the N sound classes or signal types;

determining, by the hearing device, for each of the N sound classes or signal types an overall usage quantity from the logged usage quantities for each of the N sound classes or signal types;

determining from the overall usage quantity sound classes or signal types of the N sound classes or signal types having an overall usage quantity exceeding a minimum overall usage quantity as being relevant sound classes or signal types;

determining based on at least one of the sound classes or signal types a useful hearing device feature configured to process the input sound signal associated with the relevant sound class or signal type and determining a hearing program associated with the useful hearing device feature; and providing a new hearing program to the hearing device such that the number of hearing programs available in the hearing device increases based on the determined useful hearing device feature.

2. The method of claim 1, further comprising selecting at least one of the useful hearing device features for use in the hearing device of the user.

3. The method of claim 1, further comprising removing or disabling a hearing profile from the hearing device of the user.

4. The method of claim 1, wherein providing information about the useful hearing device features comprises providing a degree of usefulness for each of the useful hearing device features based on the logged usage quantities.

5. The method of claim 1, wherein the information is part of a fitting process.

6. The method of claim 1, further comprising:

providing P1 hearing programs in the hearing device, wherein P1 ≥2;

associating each one of the P1 hearing programs with one of the N sound classes and/or signal types, wherein N>P1, determining whether a one of the P1 hearing programs is associated with the one of the sound classes and/or signal types associated with the input sound signal; and activating said one of the P1 hearing programs.

7. The method of claim 6, further comprising determining a coverage score dependent on whether a one of the P1 hearing programs was associated with the classified sound class and/or signal type or whether none of the P1 hearing programs was associated with the classified sound class and/or signal type.

8. The method of claim 7, further comprising providing an indication of a degree of possible performance improvement achievable for the user by providing further hearing device features based on the coverage score.

9. The method of claim 1, wherein the overall usage quantity comprises at least one of:

A) an occurrence where the input sound signal was associated with one of the N sound classes or signal types;

B) a time duration during which the input sound signal was associated with one of the N sound classes or signal types; and C) either A) or B) weighted by a probability that the input sound signal was correctly associated with one of the N sound classes or signal types.

10. The method of claim 1, wherein the overall usage quantity comprises at least one of:

D) a total or relative number of occurrences where the input sound signal was associated with one of the N sound classes or signal types;

E) a total or relative time duration during which the input sound signal was associated with one of the N sound classes or signal types; and F) a total or relative quantity based on either A) or B).

* * * * *